US011696651B2

(12) United States Patent
Manwaring

(10) Patent No.: US 11,696,651 B2
(45) Date of Patent: Jul. 11, 2023

(54) CRIB CONVERSION DEVICES FOR ENABLING BOUNCING MOTION

(71) Applicant: Ryan Taylor Manwaring, Nampa, ID (US)

(72) Inventor: Ryan Taylor Manwaring, Nampa, ID (US)

( * ) Notice: Subject to any disclaimer, the term of this patent is extended or adjusted under 35 U.S.C. 154(b) by 0 days.

(21) Appl. No.: 17/344,749

(22) Filed: Jun. 10, 2021

(65) Prior Publication Data

US 2022/0395110 A1 Dec. 15, 2022

(51) Int. Cl.

| | |
|---|---|
| ***A47D 7/03*** | (2006.01) |
| ***A47D 9/02*** | (2006.01) |
| ***A47D 9/00*** | (2006.01) |
| ***A47D 15/00*** | (2006.01) |

(52) U.S. Cl.

CPC ..... *A47D 7/03* (2013.01); *A47D 9/00* (2013.01); *A47D 9/02* (2013.01); *A47D 15/008* (2013.01)

(58) Field of Classification Search

CPC ..... A47G 9/083; A47C 21/006; A47C 17/84; A47D 9/04; A47D 9/02; A47D 7/03; A47D 9/012; A47D 9/057; A47D 7/04; A61M 2021/0022; A61M 21/02; A61B 2503/04

See application file for complete search history.

(56) References Cited

U.S. PATENT DOCUMENTS

| | | | | |
|---|---|---|---|---|
| 3,874,011 | A * | 4/1975 | Walsh | A47D 9/02 5/108 |
| 4,977,631 | A * | 12/1990 | Bretz | A47C 17/84 267/74 |
| 5,088,138 | A * | 2/1992 | Munster | A47D 9/02 5/101 |
| 2006/0207022 | A1 * | 9/2006 | Jenkins | A47D 9/02 5/93.1 |
| 2016/0166081 | A1 | 6/2016 | Karp et al. | |
| 2019/0290011 | A1 | 9/2019 | Fratila | |
| 2020/0171271 | A1 | 6/2020 | Karp et al. | |

FOREIGN PATENT DOCUMENTS

| | | | | |
|---|---|---|---|---|
| WO | WO-2004019732 A1 * | 3/2004 | ..... | A47C 17/84 |

* cited by examiner

*Primary Examiner* — David R Hare
*Assistant Examiner* — Madison Emanski

(57) ABSTRACT

Systems and methods for enabling bouncing motion using conversion devices in accordance with embodiments of the invention are disclosed. In one embodiment, a conversion kit comprises a plurality of support members, a motor, a crankshaft, and an attachment member, wherein the plurality of support members connects a frame of the crib to a mattress support platform of the crib, the crankshaft comprises an output shaft, and the crankshaft is powered by the motor, and the attachment member connects the output shaft of the crankshaft to the mattress support platform of the crib.

18 Claims, 11 Drawing Sheets

CRIB CONVERSION DEVICES FOR ENABLING BOUNCING MOTION

FIELD OF THE INVENTION

The present invention generally relates to mechanical devices and more specifically to crib conversion devices for enabling up and down or bouncing motion.

BACKGROUND

A crib is a high-sided bed for infants and young children. A typical crib may include a mattress support platform, a frame, and four legs. Generally, a mattress support platform may include a grid of members that provides support for a mattress. Further, the mattress support platform may be enclosed within the crib's frame, which may be made up of four rectangular faces that intersect at right angles and form the sides of the crib. Each of these four faces may include slats to ensure a child's visibility while also preventing the child from rolling out of the crib. The mattress support platform may be attached to the frame of the crib using connecting members such as metal brackets. In addition, the frame may be suspended off the ground using the four legs.

SUMMARY OF THE INVENTION

The various embodiments of the present conversion devices contain several features, no single one of which is solely responsible for their desirable attributes. Without limiting the scope of the present embodiments, their more prominent features will now be discussed below. In particular, the present conversion devices will be discussed in the context of enabling bouncing motion in a crib. However, the use of the conversion devices to enable bouncing motion in a crib is merely exemplary and various other conversion devices may be utilized to enable bouncing motion in other items as appropriate to the requirements of a specific application in accordance with various embodiments of the invention. After considering this discussion, and particularly after reading the section entitled "Detailed Description," one will understand how the features of the present embodiments provide the advantages described here.

In a first aspect, a conversion kit for enabling bouncing motion of a stationary crib is provided, the conversion kit comprising a plurality of support members configured to connect a frame of the crib to a mattress support platform of the crib, a motor, a crankshaft comprising an output shaft, wherein the crankshaft is powered by the motor, and an attachment member that attaches to the output shaft of the crankshaft and connects the output shaft to the mattress support platform of the crib.

In an embodiment of the first aspect, each support member of the plurality of support members comprises a spring having a loop on one end and a hook on the other.

In another embodiment of the first aspect, the spring is wrapped in fabric.

In another embodiment of the first aspect, each support member of the plurality of support members comprises an elastic cord having a hook-and-loop fastener on one end and a piece of plastic or metal with an eyelet on the other.

In another embodiment of the first aspect, the elastic cord comprises a rubber bungee cord.

In another embodiment of the first aspect, the output shaft comprises a hole for attaching the attachment member.

In another embodiment of the first aspect, the attachment member comprises an inelastic cord connected to a hook-and-loop fastener on one end and a hook on the other.

In another embodiment of the first aspect, the conversion kit further comprises an angular metal bracket with two slots and a hole for inserting the motor.

In another embodiment of the first aspect, the angular metal bracket is covered with silicone on one surface to prevent the angular metal bracket from sliding down or scratching the crib.

In another embodiment of the first aspect, the conversion kit further comprises two binding members for sliding into the two slots of the angular metal bracket and binding the angular metal bracket to the crib.

In another embodiment of the first aspect, each of the two binding members comprises a hook-and-loop fastener.

In another embodiment of the first aspect, the plurality of support members comprises two support members for enabling bouncing motion on one end of the mattress support platform of the crib.

In another embodiment of the first aspect, the motor comprises an AC motor with variable speed.

In another embodiment of the first aspect, the conversion kit further comprises a coupling flange connected to the motor.

In another embodiment of the first aspect, the coupling flange comprises a hole for connecting the coupling flange to the output shaft.

In another embodiment of the first aspect, the crankshaft further comprises a plurality of stabilizing braces for ensuring vertical motion in the output shaft.

In another embodiment of the first aspect, the plurality of stabilizing braces comprises two vertical stabilizing braces connected to one horizontal stabilizing brace.

In another embodiment of the first aspect, the output shaft comprises a lower output shaft connected to an upper output shaft.

BRIEF DESCRIPTION OF THE DRAWINGS

The various embodiments of the present conversion device now will be discussed in detail with an emphasis on highlighting the advantageous features. These embodiments depict the novel and non-obvious conversion devices shown in the accompanying drawings, which are for illustrative purposes only. These drawings include the following figures.

DETAILED DESCRIPTION OF THE DRAWINGS

Figure 1:
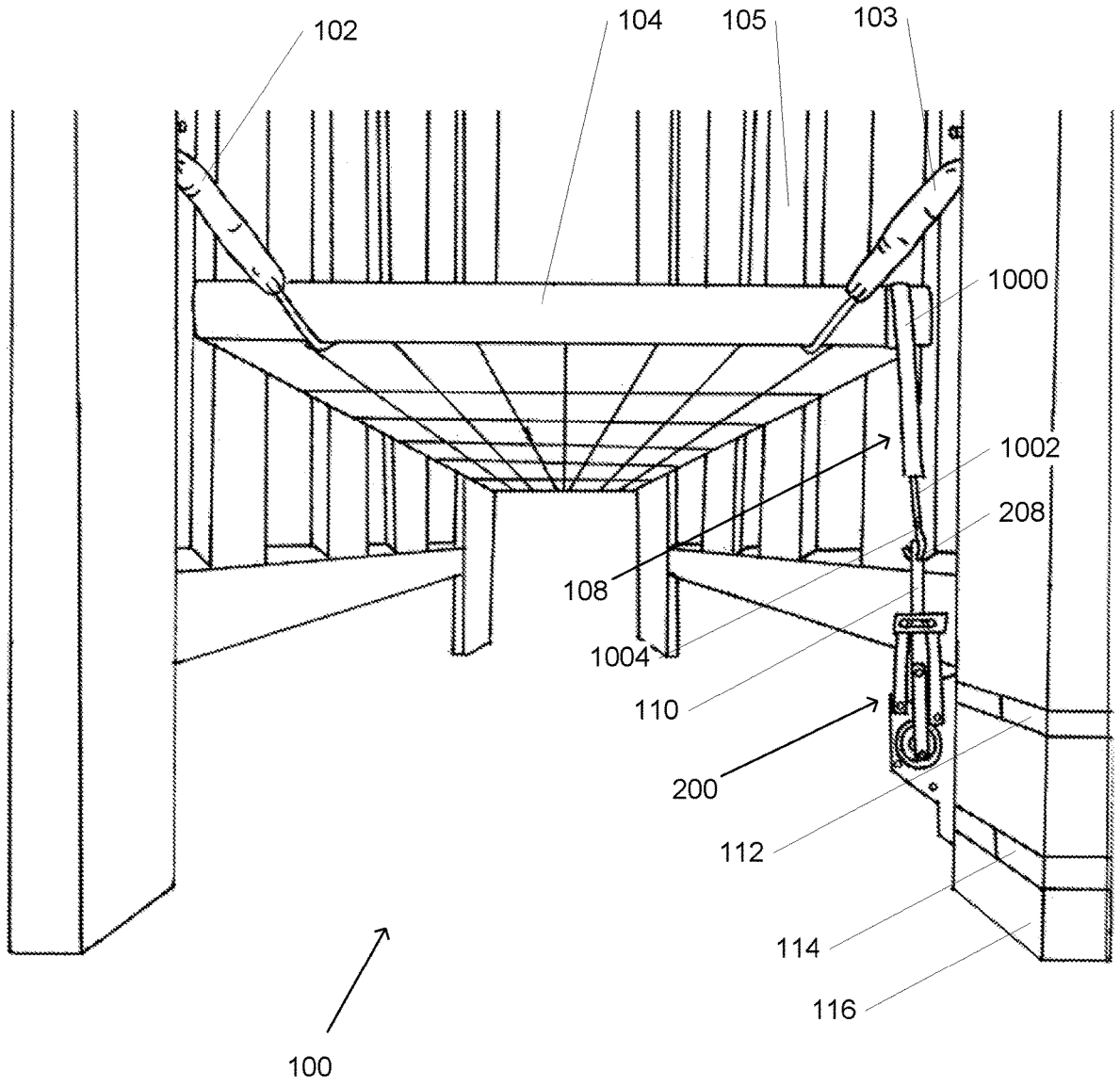
FIG. 1 is a front perspective view of a conversion device using two support members in accordance with an embodiment of the invention.

The following detailed description describes the present embodiments with reference to the drawings. In the drawings, reference numbers label elements of the present embodiments. These reference numbers are reproduced below in connection with the discussion of the corresponding drawing features.

Turning now to the drawings, methods and devices for enabling bouncing motion in accordance with embodiments of the invention are provided. As further described below, the embodiments of the invention will be described in the context of cribs. However, the use of cribs is only exemplary and one of ordinary skill will appreciate that the methods and devices for enabling bouncing motion may be utilized on a variety of products. In many embodiments, conversion devices may include a plurality of support members. In various embodiments, support members may replace original supports (e.g., brackets) which may attach a crib's frame to its mattress support platform. In several embodiments, conversion devices may include a motor which may power a crankshaft. In many embodiments, the crankshaft's output shaft may be connected to the mattress support platform of the crib using an attachment member, as further described below. In a variety of embodiments, when the motor is turned on, the output shaft may pull the mattress support platform in a vertical motion, thereby enabling a bouncing motion. In various embodiments, the bouncing motion may help a child in the crib fall asleep. Conversion devices for enabling bouncing motion in accordance with embodiments of the invention are further discussed below.

Conversion Device as Applied to a Crib

Conversion devices may enable bouncing motion to help a baby fall asleep in a crib. A crib may include four legs which support the frame. Within the frame may be a mattress support platform, which may be attached to the frame using brackets, as further described below.

A conversion device utilizing two spring support members in accordance with an embodiment of the invention is illustrated in FIG. 1. The conversion device 100 may include one or more support members such as, but not limited to, two spring support members 102, 103. In many embodiments of the conversion device 100, the two spring support members 102, 103 may replace two adjacent brackets connecting the frame 105 of the crib to the mattress support platform 104, as further described below. The replacement of two adjacent brackets with the two spring support members 102, 103 may allow one end of the mattress support platform 104 to bounce.

In reference to FIG. 1, the conversion device 100 may include a crankshaft and motor assembly 200, which may include an upper output shaft 110 with an output shaft hole 208. In many embodiments, the conversion device 100 may also include an attachment member 108, which may comprise a hook and loop fastener for an attachment member 1000, an inelastic cord 1002, and a hook for an attachment member 1004, as further described below. Using the attachment member 108 to connect the mattress support platform 104 to the upper output shaft 110 may be achieved by fastening the hook and loop fastener for an attachment member 1000 around the side of the mattress support platform 104 that is supported by the two spring support members 102, 103 and inserting the hook for an attachment member 1004 into the output shaft hole 208. The connection of the mattress support platform 104 to the upper output shaft 110 may allow the upper output shaft 110 to pull the mattress support platform 104 in a vertical motion when the crankshaft and motor assembly 200 is turned on, as further described below.

In further reference to FIG. 1, the crankshaft and motor assembly 200 may include two binding members 112, 114. The binding members 112, 114 may be fastened around a leg 116 of the crib to bind the crankshaft and motor assembly 200 to the leg 116, as further described below. Although specific conversion devices are discussed above with respect to FIG. 1, any of a variety of conversion devices, including, but not limited to, having crankshaft and motor assemblies in various configurations, can be utilized in accordance with embodiments of the invention. Crankshaft and motor assemblies in accordance with embodiments of the invention are discussed further below.

Crankshaft and Motor Assemblies

An electric motor is a machine that converts electrical energy into mechanical motion. An electric motor may produce rotary force that may be used to propel a drive shaft. An AC motor is powered by alternating current sources. A crankshaft is a mechanical entity that can convert rotational motion into reciprocating motion. A crankshaft may include a shaft driven by a crank mechanism, wherein the rotational motion of the crank may be converted into reciprocating motion in the shaft.

Figure 2:
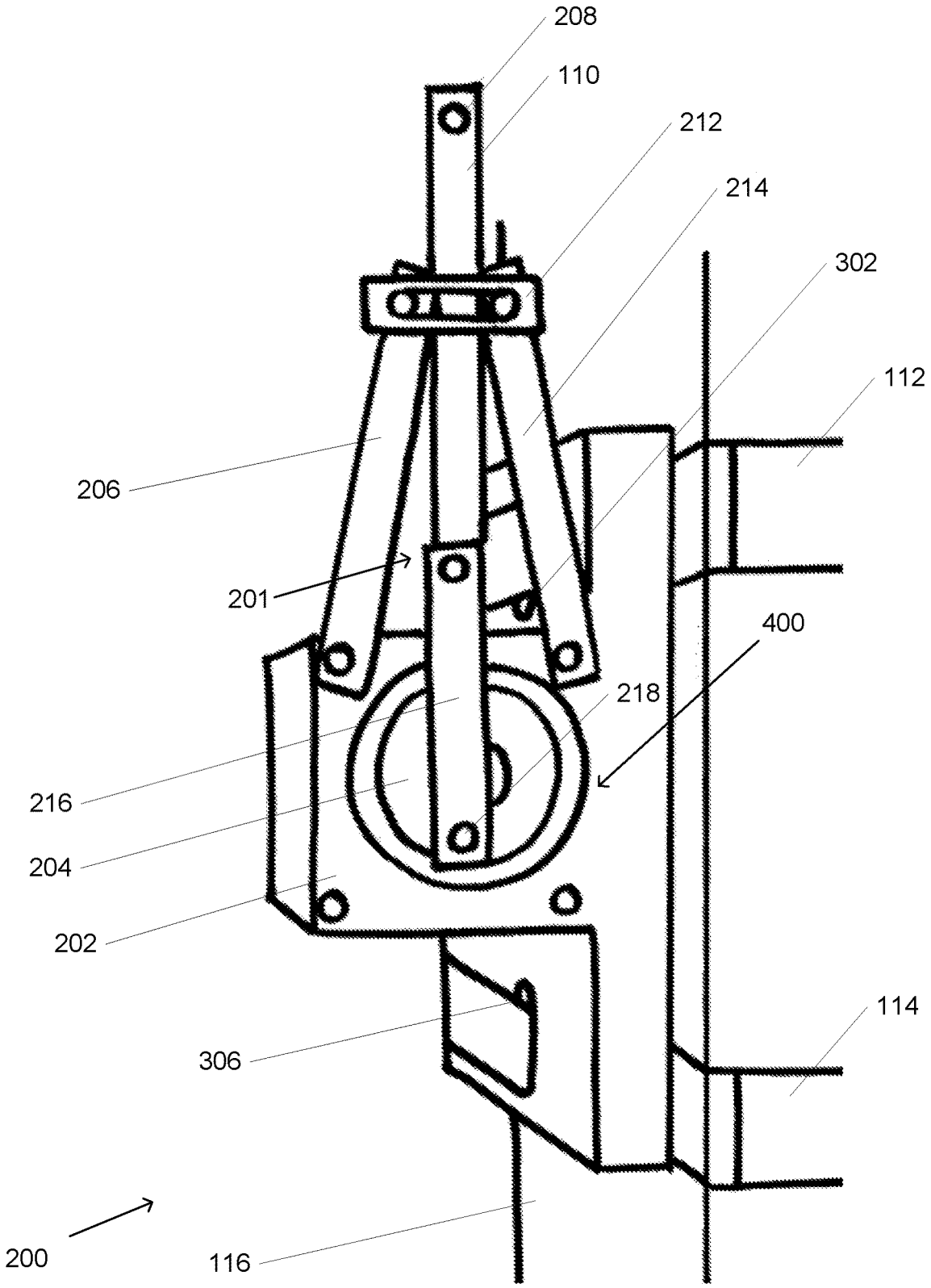
FIG. 2 illustrates a crankshaft and a motor attached to an angular metal bracket in accordance with an embodiment of the invention.

In many embodiments of conversion devices, crankshaft and motor assemblies may pull a mattress support platform in a vertical motion. A crankshaft and motor assembly in accordance with an embodiment of the invention is illustrated in FIG. 2. The crankshaft and motor assembly 200 may include an angular metal bracket 202 with two binding member holes 302, 306. The crankshaft and motor assembly 200 may also include two binding members 112, 114. In many embodiments, the two binding members 112, 114 may each include a hook and loop fastener. The first binding member 112 may slide through the first binding member hole 302, and the second binding member 114 may slide through the second binding member hole 306. The binding members 112, 114 may be fastened around a leg 116 of the crib, binding the crankshaft and motor assembly 200 to the leg 116.

In reference to FIG. 2, the angular metal bracket 202 may be attached to a motor assembly 400, as further described below. The motor assembly 400 may include a coupling flange 204, which may include a rotational hole 218, as further described below. Further, the crankshaft and motor assembly 200 may a crankshaft 201 that may include a lower output shaft 216 and an upper output shaft 110. The upper output shaft 110 may include an output shaft hole 208. The lower output shaft 216 may be attached to the upper output shaft 110 with a screw, and the screw may be loose enough to maintain pivoting motion in the upper output shaft 110. The lower output shaft 216 may also be connected to the coupling flange 204 by inserting a screw into the lower output shaft 216 and the rotational hole 218.

In further reference to FIG. 2, the upper output shaft 110 may be between two vertical stabilizing braces 206, 214. The vertical stabilizing braces 206, 214 may be held in a stationary position by a horizontal stabilizing brace 212. The vertical stabilizing braces 206, 214 may be attached to the horizontal stabilizing brace 212 using screws such that there remains enough space between the vertical stabilizing braces 206, 214 for the upper output shaft 110 to slide vertically between the vertical stabilizing braces 206, 214. The vertical stabilizing braces 206, 214 may also be attached to the angular metal bracket 202 with screws.

In further reference to FIG. 2, when the motor assembly 400 is turned on, the coupling flange 204 may rotate. The coupling flange 204 may then pull the lower output shaft 216 in a circular motion. When the lower output shaft 216 is pulled in a circular motion, the upper output shaft 110 may be pulled in a vertical motion. Any horizontal motion of the upper output shaft 110 may be restricted by the vertical stabilizing braces 206, 214. As illustrated in FIG. 1, if the upper output shaft 110 is attached to a mattress support platform 104 using an attachment member 108, the vertical motion of the upper output shaft 110 may enable a bouncing motion in the mattress support platform 104.

Figure 3:
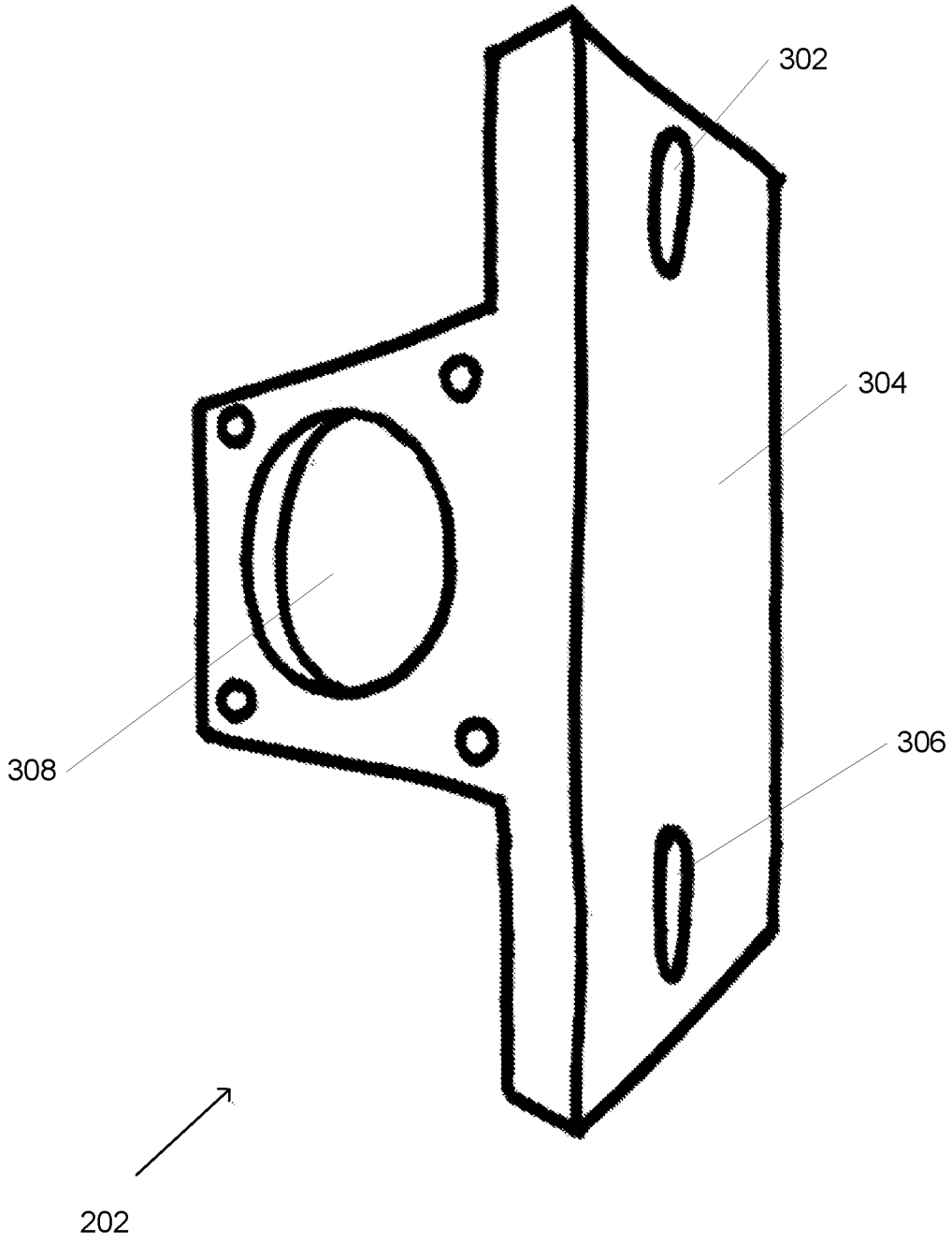
FIG. 3 illustrates a perspective view of an angular metal bracket in accordance with an embodiment of the invention.

An angular metal bracket in accordance with an embodiment of the invention is illustrated in FIG. 3. The angular metal bracket 202 may be shaped in a right angle. The angular metal bracket 202 may include a motor insertion hole 308. The angular metal bracket 202 may include two binding member holes 302, 306, which may be thin slots. In various embodiments, the angular metal bracket 202 may include a silicone surface 304. The silicone surface 304 may be a side of the angular metal bracket 202 which is covered with silicone such that when the silicone surface 304 contacts the leg of a crib, the angular metal bracket 202 may not scratch the leg and may be less prone to sliding down the leg. As illustrated in FIG. 2, two binding members 112, 114 may be inserted into the binding member holes 302, 306 of the angular metal bracket 202 to bind the crankshaft and motor assembly 200 to a leg 116 of the crib. A motor assembly 400 may be attached to the angular metal bracket 202 with screws such that the coupling flange 204 is in the motor insertion hole. Two vertical stabilizing braces 206, 214 may also be attached to the angular metal bracket 202 with screws.

Figure 4:
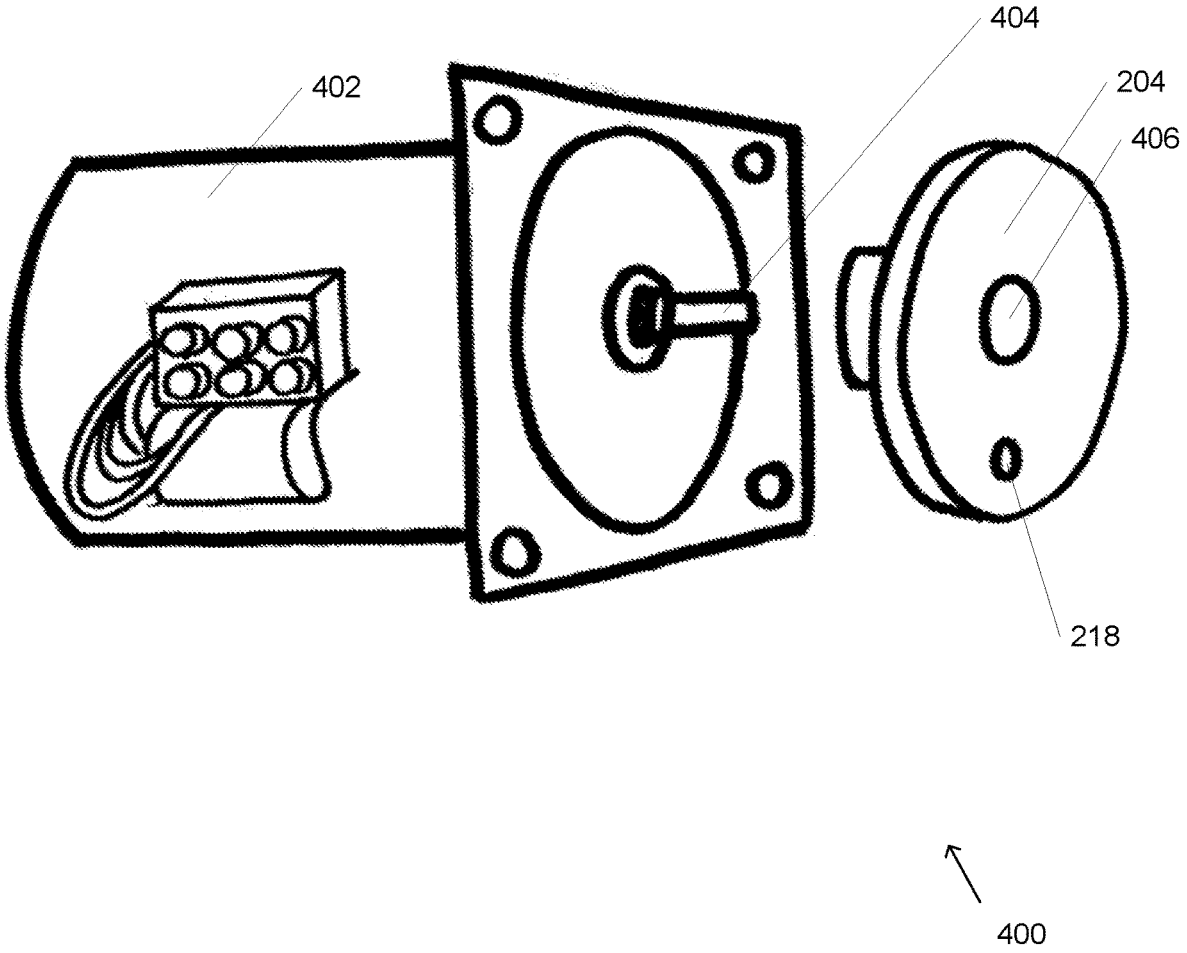
FIG. 4 illustrates a motor and a coupling flange in accordance with an embodiment of the invention.

An exploded view of a motor assembly in accordance with an embodiment of the invention is illustrated in FIG. 4. In various embodiments, a motor assembly 400 includes a motor 402 with a drive shaft 404. The motor 402 may be implemented in a manner known to one of ordinary skill in the art. The motor 402 may be an AC motor with variable speed. The motor assembly 400 may also include a coupling flange 204 with a drive shaft insertion hole 406 and a rotational hole 218. The drive shaft 404 may be attached to the coupling flange 204 using a screw that is inserted through the drive shaft insertion hole 406. When the motor 402 is turned on, the drive shaft 404 and the coupling flange 204 may rotate. As illustrated in FIG. 2, the motor assembly 400 may be attached to an angular metal bracket 202 and a lower output shaft 216 as part of a crankshaft and motor assembly 200.

Although specific crankshaft and motor assemblies are discussed above with respect to FIGS. 2-4, any of a variety of crankshaft and motor assemblies can be utilized in accordance with embodiments of the invention. In various embodiments of the invention, support members are used to replace the brackets that attach the frame of a crib to the mattress support platform. Replacing brackets with support members in accordance with embodiments of the invention is discussed further below.

Attachment of Support Members

Figure 5:
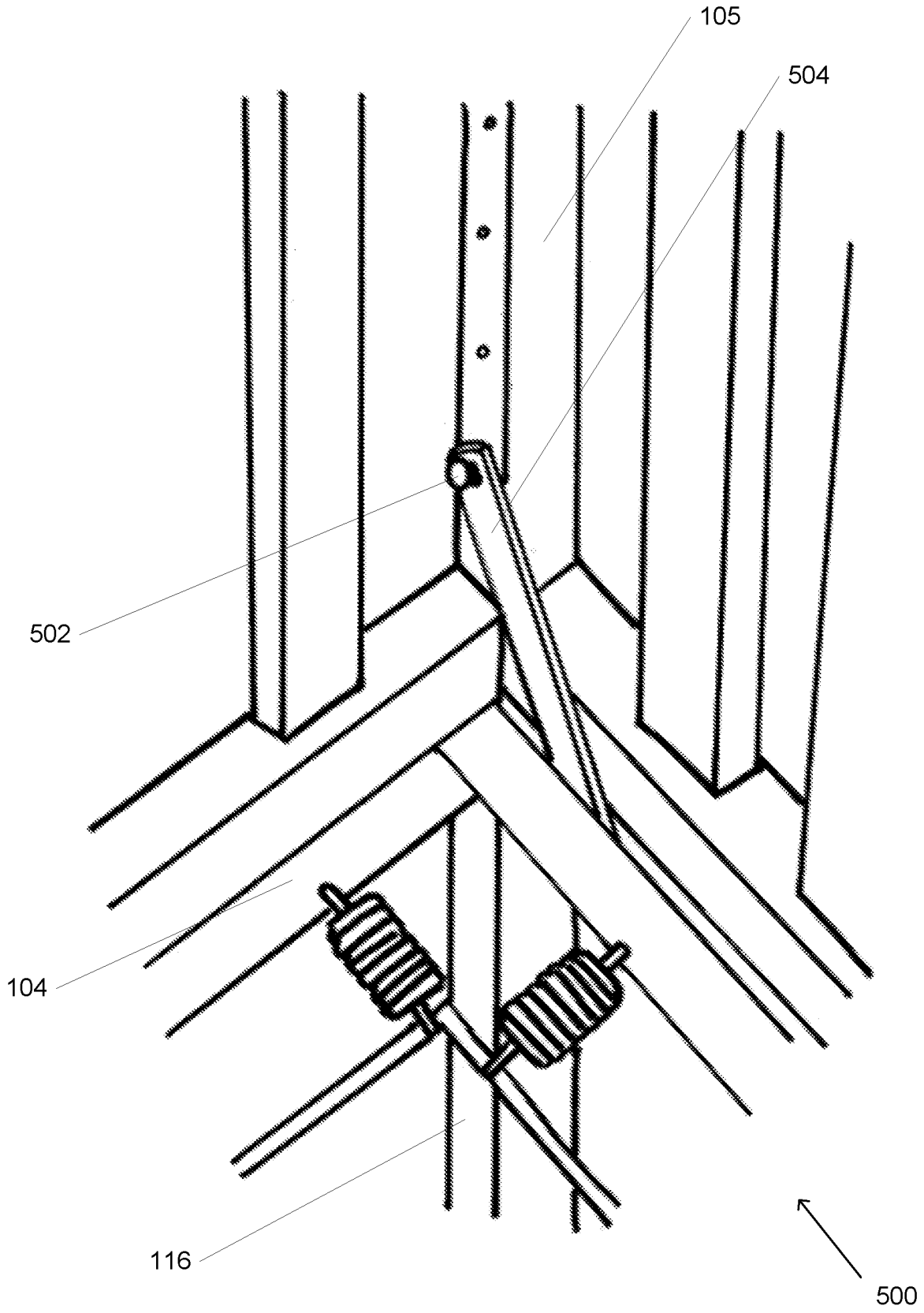
FIG. 5 illustrates a metal bracket attaching the frame of the crib to the mattress support platform in accordance with an embodiment of the invention.

In many embodiments of conversion devices, a crib's brackets may be replaced by various support members. A crib with its original bracket 500 in accordance with an embodiment of the invention is illustrated in FIG. 5. The frame 105 of a crib may be connected to a mattress support platform 104 with a bracket 504. The bracket 504 may include a strip of metal with holes at both ends. The bracket 504 may be attached to the frame 105 by inserting a screw 502 into the frame 105 and one of the holes in the bracket 504. The other end of the bracket 504 may be attached to the mattress support platform 104 by inserting a screw into the mattress support platform 104 and the other hole in the bracket 504. When the bracket 504 is attached to both the frame 105 and the mattress support platform 104, a corner of the mattress support platform 104 may be suspended within the frame 105 and above a leg 116 of the crib. Typically, each of the four corners of the mattress support platform 104 may be attached to the frame 105 using brackets, which may ensure the stability of the mattress support platform 104.

Figure 6:
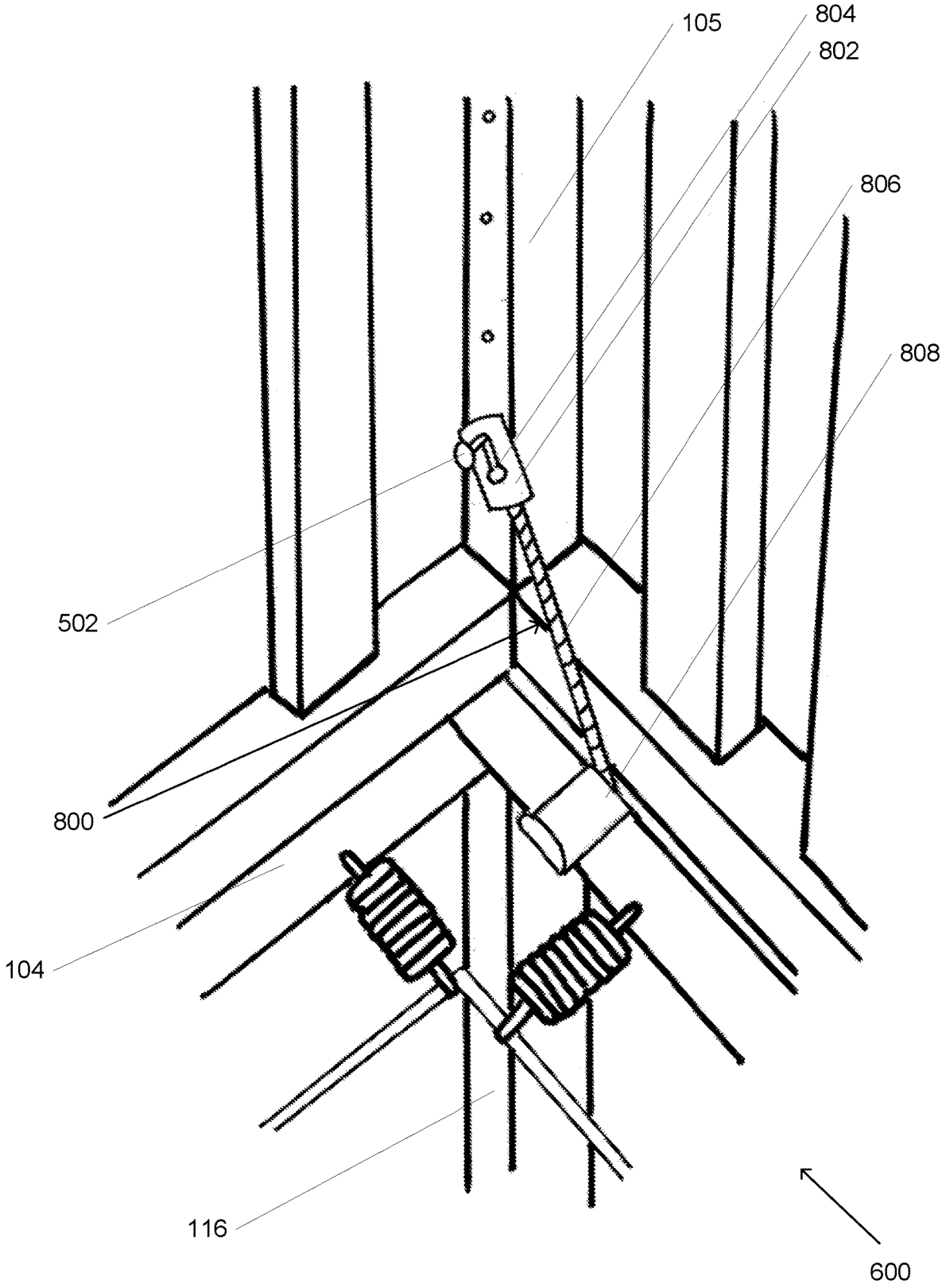
FIG. 6 illustrates a support member in an elastic cord embodiment attaching the frame of the crib to the mattress support platform in accordance with an embodiment of the invention.

An elastic cord support member replacing a bracket 600 in accordance with an embodiment of the invention is illustrated in FIG. 6. In several embodiments, a bracket may be replaced by an elastic cord support member 800. An elastic cord support member 800 may include a piece of material 802 with an eyelet 804, an elastic cord 806, and a hook and loop fastener for an elastic cord support member 808, as further illustrated below. An elastic cord support member 800 may be attached to the frame 105 by inserting a screw 502 embedded in the frame 105 into the eyelet 804. The elastic cord support member 800 may also be attached to the mattress support platform 104 by fastening the hook and loop fastener for an elastic cord support member 808 around the side of the mattress support platform 104. The elastic cord support member 800 may allow the mattress support platform 104 to bounce while remaining attached to the frame 105. In many embodiments, a plurality of brackets will be replaced by elastic cord support members in this manner.

Figure 7:
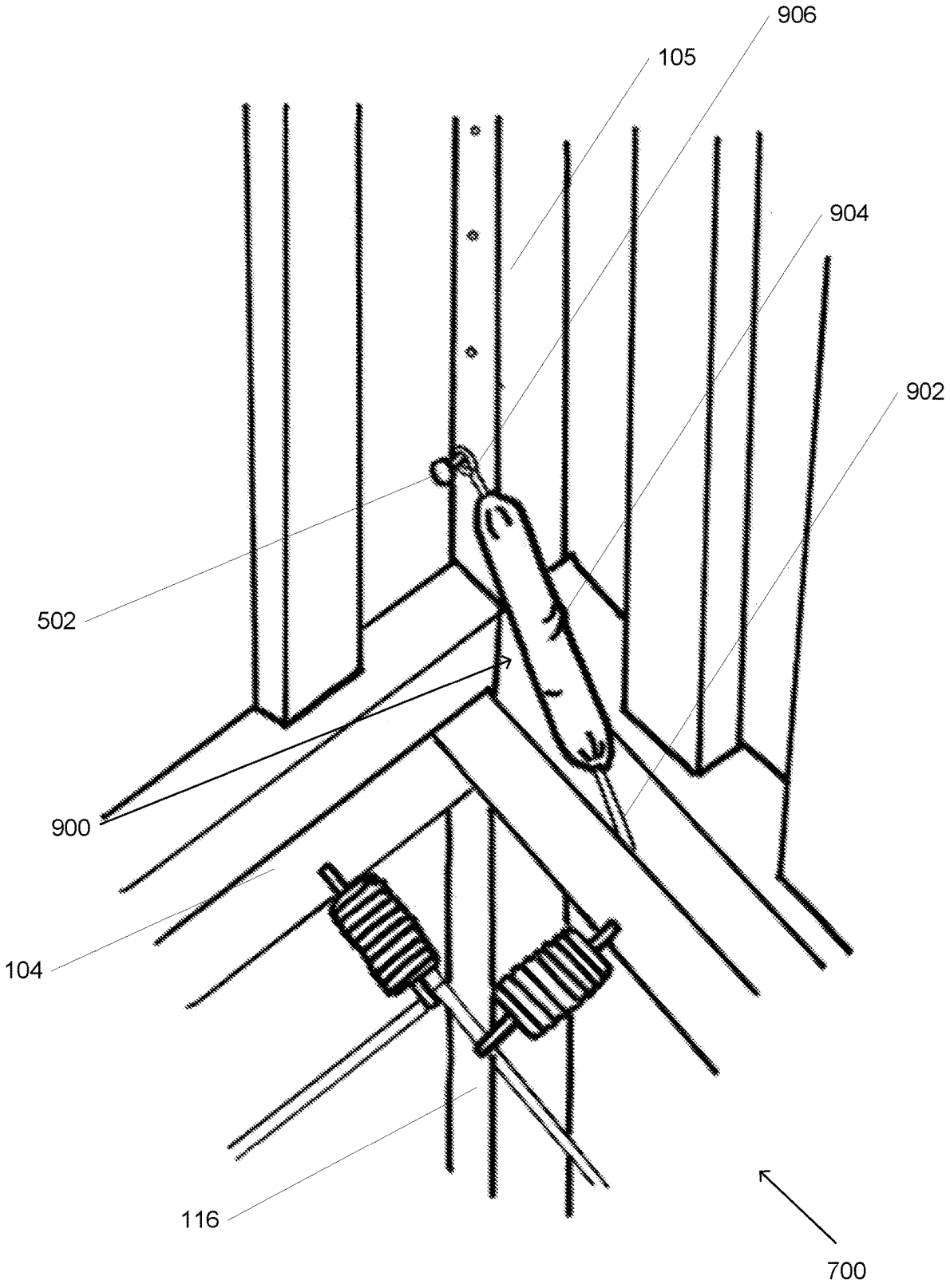
FIG. 7 illustrates a support member in a spring embodiment attaching the frame of the crib to the mattress support platform in accordance with an embodiment of the invention.

A spring support member replacing a bracket 700 in accordance with an embodiment of the invention is illustrated in FIG. 7. In several embodiments, a bracket may be replaced by a spring support member 900. A spring support member 900 may include a loop 906, a spring wrapped in fabric 904, and a hook for a spring support member 902, as further illustrated below. A spring support member 900 may be attached to the frame 105 by inserting a screw 502 embedded in the frame 105 into the loop 906. The spring support member 900 may also be attached to the mattress support platform 104 by fixing the hook for a spring support member 902 under the outer edge of the mattress support platform 104. The spring support member 900 may allow the mattress support platform 104 to bounce while remaining attached to the frame 105. In many embodiments, a plurality of brackets will be replaced by spring support members, as illustrated in FIG. 1, by the example spring support members 102, 103.

Although specific connecting members for replacing the brackets of a crib are discussed above with respect to FIGS. 5-7, any of a variety of connecting members for replacing the brackets of a crib can be utilized in accordance with embodiments of the invention. Various connecting members in accordance with embodiments of the invention are discussed further below.

Various Connecting Members

Figure 8:
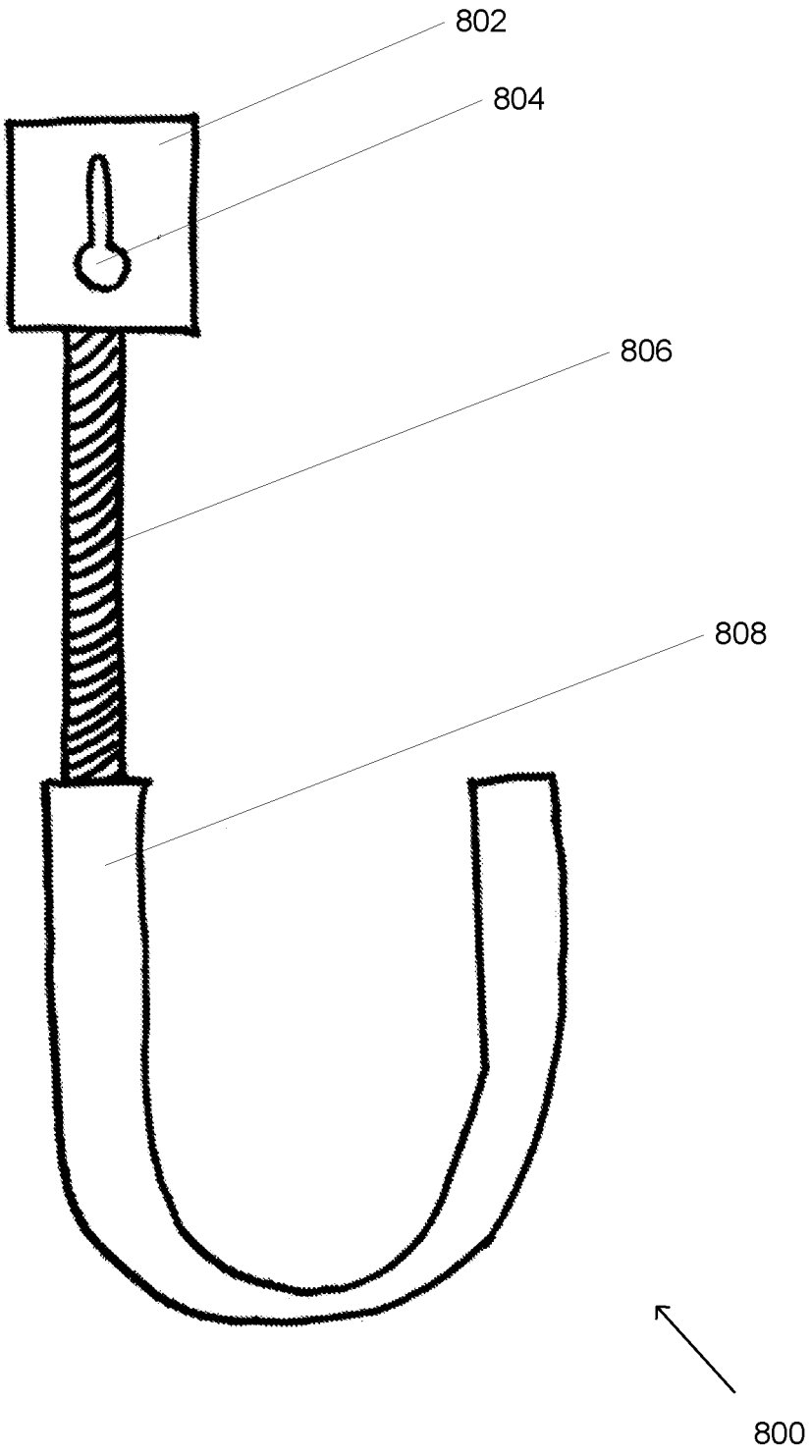
FIG. 8 illustrates an elastic cord support member in accordance with an embodiment of the invention.

In many embodiments of conversion devices, various connecting members may attach the components of the conversion device to each other and/or to the crib. An elastic cord support member in accordance with an embodiment of the invention is illustrated in FIG. 8. In many embodiments, the elastic cord support member 800 includes a piece of material 802. The piece of material 802 may be rectangular in shape and may be made of plastic or fabric. The piece of material 802 may be durable to sustain the weight of a mattress support platform. The piece of material 802 may include an eyelet 804, which may be in the shape of a circle or a keyhole slot. The piece of material 802 may be connected to an elastic cord 806, which may be a rubber bungee cord. The elastic cord 806 may be attached to a hook and loop fastener for an elastic cord support member 808. As illustrated in FIG. 6, an elastic cord support member 800 may replace a bracket of a crib.

Figure 9:
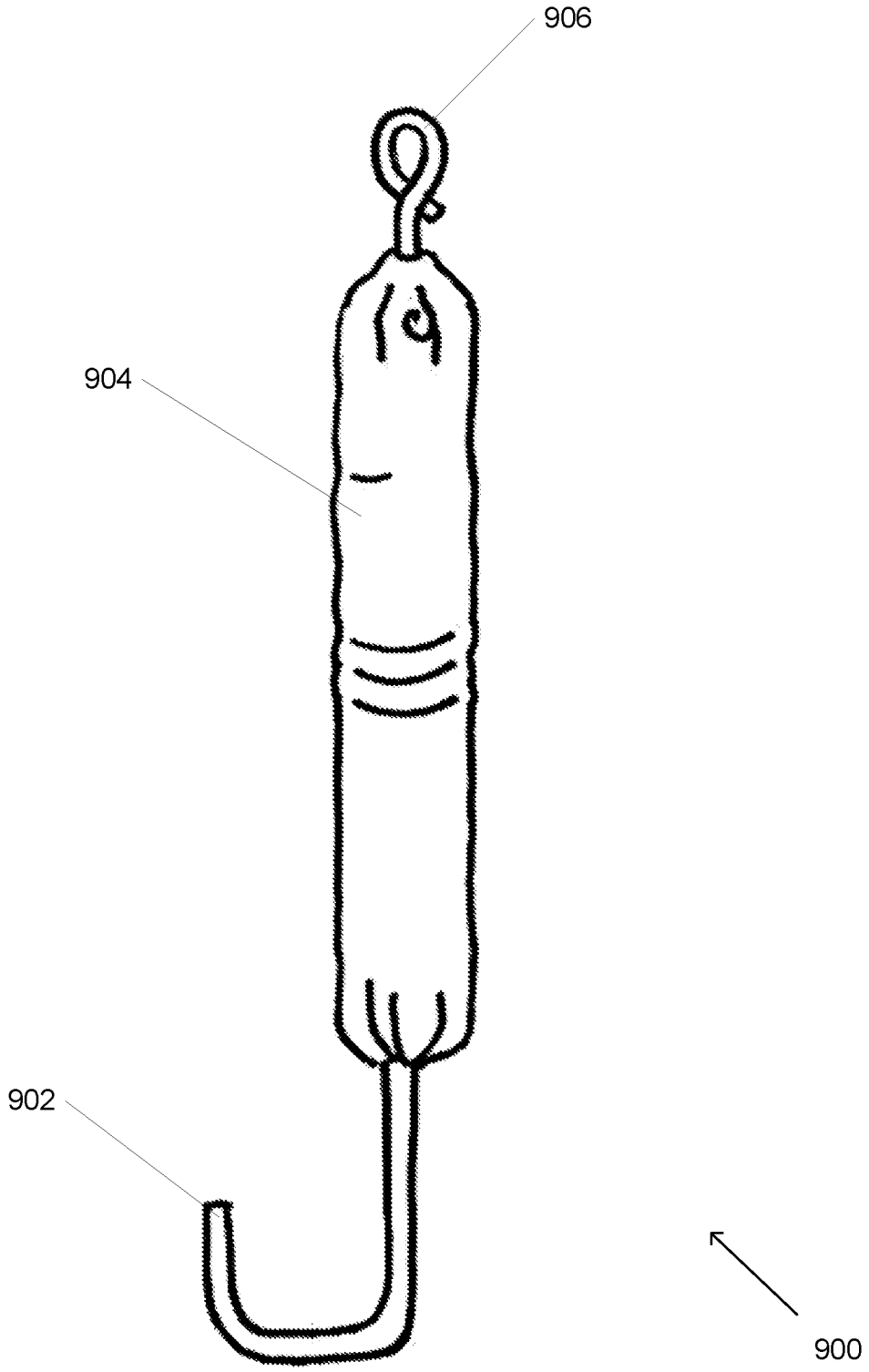
FIG. 9 illustrates a spring support member in accordance with an embodiment of the invention.

A spring support member in accordance with an embodiment of the invention is illustrated in FIG. 9. In many embodiments, the spring support member 900 may include a spring wrapped in fabric 904 with a loop 906 at one end and a hook for a spring support member 902 at the other. A spring wrapped in fabric 904 may include a fabric cover to prevent a child from being injured by the coils of the spring. The fabric cover of the spring wrapped in fabric 904 may be durable to prevent wear and tear from the expansion and compression of the enclosed spring. The spring support member 900 may replace a bracket of a crib, as illustrated in FIG. 7. In FIG. 1, two spring support members 102, 103 replacing two brackets of a crib is illustrated.

Figure 10:
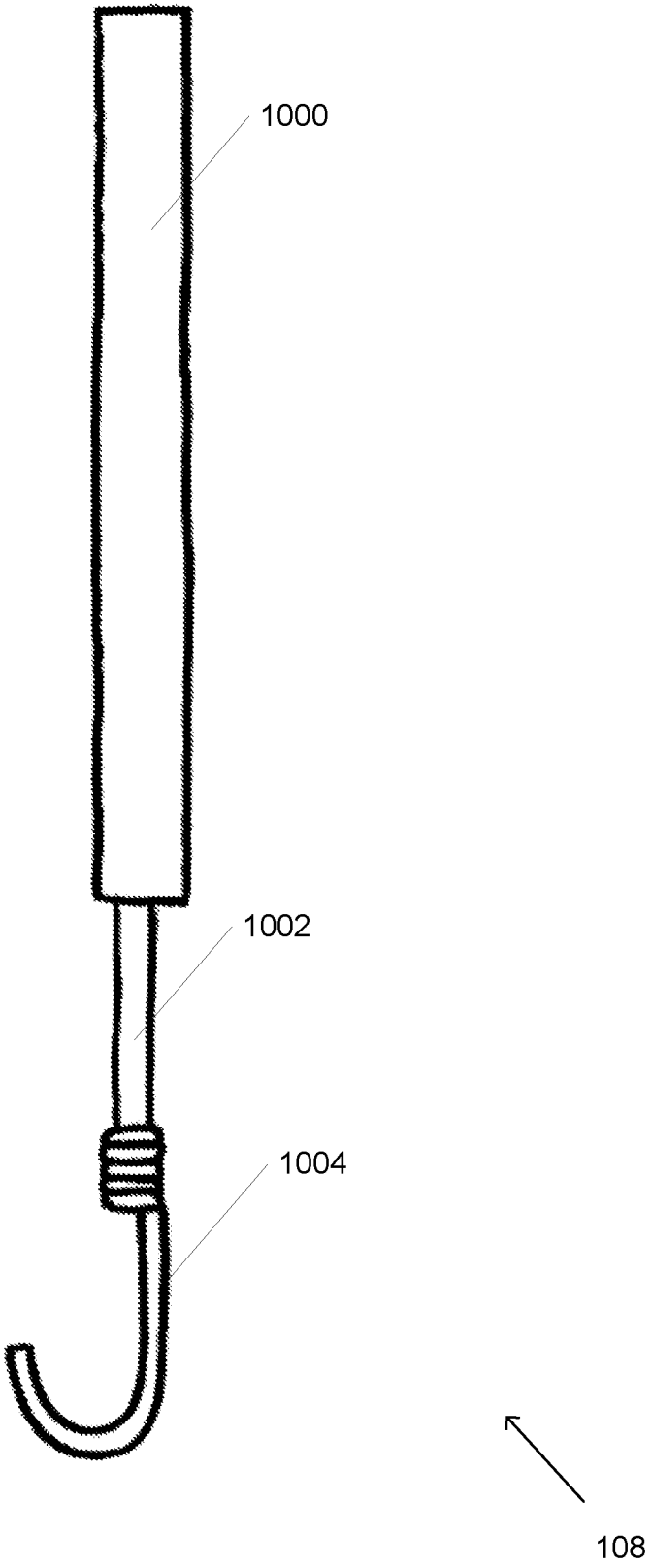
FIG. 10 illustrates an attachment member in accordance with an embodiment of the invention.

An attachment member is illustrated in FIG. 10. In several embodiments, the attachment member 108 may include a hook and loop fastener for an attachment member 1000 connected to an inelastic cord 1002 and a hook for an attachment member 1004. As illustrated in FIG. 1, the attachment member 108 may connect an upper output shaft 110 of a crankshaft and motor assembly 200 to the mattress support platform 104. Although specific connecting members are discussed above with respect to FIGS. 8-10, any of a variety of connecting members can be utilized in accordance with embodiments of the invention. Processes for enabling bouncing motion for cribs using conversion devices is further discussed below.

Crib Conversion Processes

Figure 11:
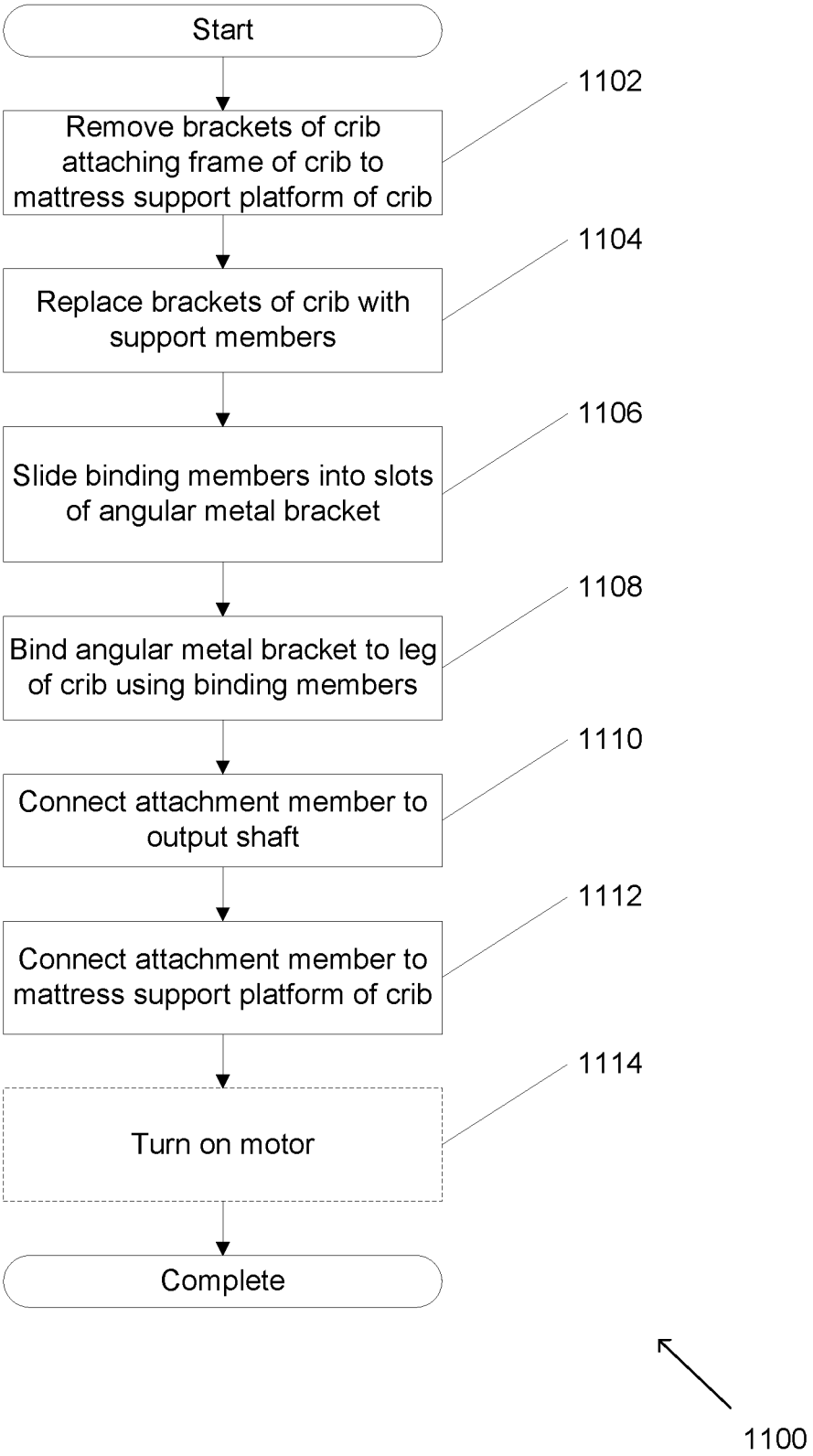
FIG. 11 is a flowchart illustrating a process of enabling bouncing motion in a crib in accordance with an embodiment of the invention.

Another aspect of the invention provides methods for enabling bouncing motion in a crib. A flowchart illustrating a process for enabling bouncing motion in a crib in accordance with an embodiment of the invention is illustrated in FIG. 11. The process 1100 may include removing (1102) several brackets that attach the frame of the crib to the mattress support platform and replacing (1104) the brackets with support members, as further described below. The process 1100 may also include sliding (1106) binding members into the slots of an angular metal bracket, binding (1108) the angular metal bracket to a leg of the crib using the binding members, connecting (1110) the attachment member to an output shaft of a crankshaft and motor assembly, and connecting (1112) the attachment member to the mattress support platform, as further described below. In some embodiments, the process 1100 may also include turning on (1114) the motor in the crankshaft and motor assembly.

In reference to FIG. 11, the removing (1102) of the brackets of a crib (see also FIG. 5), may be accomplished by detaching the bracket 504 from a screw 502 that is embedded in the frame 105 of a crib. The bracket 504 may then be pivoted such that the bracket 504 is parallel to the mattress support platform 104. Alternatively, the bracket 504 may be detached completely by removing a screw attaching the bracket 504 to the mattress support platform 104. In accordance with various embodiments of the present invention, two adjacent brackets may be removed to enable bouncing motion on one end of the mattress support platform 104.

Further, replacing (1104) the removed brackets with support members may involve replacing each removed bracket with a spring support member or an elastic cord support member. For example, as illustrated FIG. 7, in various embodiments of the invention, a bracket may be replaced by a spring support member 900. A spring support member 900 may replace a bracket by positioning a loop 906 of the spring support member 900 around a screw 502 that is embedded in the frame 105 of a crib and fixing the hook for a spring support member 902 under the outer edge of a mattress support platform 104. As illustrated in FIG. 1, in various embodiments of the invention, two spring support members 102, 103 may replace two adjacent brackets to enable bouncing motion on one end of the mattress support platform 104.

In addition, and as illustrated in FIG. 6, in various embodiments of the invention, a bracket may be replaced by an elastic cord support member 800 by placing an eyelet 804 of the elastic cord support member 800 around a screw 502 that is embedded in the frame 105 of a crib and fastening a hook and loop fastener for an elastic cord support member 808 around the side of a mattress support platform 104. In accordance with various embodiments of the present invention, two adjacent brackets may be replaced by two elastic cord support members to enable bouncing motion on one end of the mattress support platform 104.

Moreover, the process 1100 may involve sliding (1106) binding members into the slots of an angular metal bracket. As illustrated in FIG. 2, the first binding member 112 may be slid into the first binding member hole 302 of the angular metal bracket 202, and the second binding member 114 may be slid into the second binding member hole 306 of the angular metal bracket 202. Furthermore, the process 1100 may involve binding (1108) the angular metal bracket to a leg of the crib using binding members. As illustrated in FIG. 2, the first binding member 112 and second binding member 114 may be fastened around a leg 116 of the crib such that the upper output shaft 110 of the crankshaft and motor assembly 200 is above the lower output shaft 216. Further, as illustrated in FIG. 6, the leg 116 on which the angular metal bracket may be affixed may be underneath an elastic cord support member replacing a bracket 600. In addition, as illustrated in FIG. 7, the leg 116 on which the angular metal bracket may be affixed may be underneath a spring support member replacing a bracket 700.

In reference to FIG. 11, the process 1100 may involve connecting (1110) an attachment member to an output shaft. As illustrated in FIG. 1, the attachment member 108 may be attached to the upper output shaft 110 by inserting the hook for an attachment member 1004 into the output shaft hole 208. Further, the process 1100 may involve connecting (1112) an attachment member to the mattress support platform of the crib. As illustrated in FIG. 1, the attachment member 108 may be attached to the mattress support platform 104 by fastening the hook and loop fastener for an attachment member 1000 onto a side of the mattress support platform 104 whose two brackets have been replaced by two support members, as exemplified by the two spring support members 102, 103. Furthermore, the process 1100 may involve turning on (1114) a motor. A motor may be turned on through a process that would be known to one of ordinary skill in the art. As illustrated in FIG. 1, when the motor is turned on, the upper output shaft 110 of the crankshaft and motor assembly 200 may pull the attachment member 108 in a vertical motion such that the mattress support platform 104 may begin to bounce on the side that is supported by two support members, as exemplified by the two spring support members 102, 103.

Although a specific process for enabling bouncing motion for cribs using conversion devices is discussed above with respect to FIG. 11, any of a variety of processes for enabling bouncing motion for cribs can be utilized in accordance with embodiments of the invention. While the above description contains many specific embodiments of the invention, these should not be construed as limitations on the scope of the invention, but rather as an example of one embodiment thereof. It is therefore to be understood that the present invention may be practiced otherwise than specifically described, without departing from the scope and spirit of the present invention. Thus, embodiments of the present invention should be considered in all respects as illustrative and not restrictive.

What is claimed is:

1. A conversion kit for enabling bouncing motion of a stationary crib, the conversion kit comprising: a plurality of support members configured to connect a frame of the crib to a mattress support platform of the crib; a motor; a crankshaft comprising an output shaft, wherein the crankshaft is powered by the motor; and an attachment member that attaches to the output shaft of the crankshaft and connects the output shaft to the mattress support platform of the crib, wherein the attachment member, the crankshaft and the motor are vertically displaced from the mattress, and the crankshaft and the motor are further fastened to a leg of the crib directly below a location where the attachment member connects to the mattress support platform, the vertical displacement of the attachment member, crankshaft and motor are configured to pull the mattress support platform via the output shaft in a vertical motion.

2. The conversion kit of claim 1, wherein each support member of the plurality of support members comprises a spring having a loop on one end and a hook on the other.

3. The conversion kit of claim 2, wherein the spring is wrapped in fabric.

4. The conversion kit of claim 1, wherein each support member of the plurality of support members comprises an elastic cord having a hook-and-loop fastener on one end and a piece of plastic or metal with an eyelet on the other.

5. The conversion kit of claim 4, wherein the elastic cord comprises a rubber bungee cord.

6. The conversion kit of claim 1, wherein the output shaft comprises a hole for attaching the attachment member.

7. The conversion kit of claim 1, wherein the attachment member comprises an inelastic cord connected to a hook-and-loop fastener on one end and a hook on the other.

8. The conversion kit of claim 1 further comprising an angular metal bracket with two slots and a hole for inserting the motor.

9. The conversion kit of claim 8, wherein the angular metal bracket is covered with silicone on one surface to prevent the angular metal bracket from sliding down or scratching the crib.

10. The conversion kit of claim 8 further comprising two binding members for sliding into the two slots of the angular metal bracket and binding the angular metal bracket to the crib.

11. The conversion kit of claim 10 wherein each of the two binding members comprises a hook-and-loop fastener.

12. The conversion kit of claim 1, wherein the plurality of support members comprises two support members for enabling bouncing motion on one end of the mattress support platform of the crib.

13. The conversion kit of claim 1, wherein the motor comprises an AC motor with variable speed.

14. The conversion kit of claim 1 further comprising a coupling flange connected to the motor.

15. The conversion kit of claim 14, wherein the coupling flange comprises a hole for connecting the coupling flange to the output shaft.

16. The conversion kit of claim 1, wherein the crankshaft further comprises a plurality of stabilizing braces for ensuring vertical motion in the output shaft.

17. The conversion kit of claim 16, wherein the plurality of stabilizing braces comprises two vertical stabilizing braces connected to one horizontal stabilizing brace.

18. The conversion kit of claim 1, wherein the output shaft comprises a lower output shaft connected to an upper output shaft.

* * * * *